US008834286B1

(12) United States Patent
Rogers

(10) Patent No.: US 8,834,286 B1
(45) Date of Patent: Sep. 16, 2014

(54) GOLF-SWING TRAINING DEVICE

(76) Inventor: Keith Rogers, Littleton, CO (US)

( * ) Notice: Subject to any disclaimer, the term of this patent is extended or adjusted under 35 U.S.C. 154(b) by 0 days.

(21) Appl. No.: 12/420,236

(22) Filed: Apr. 8, 2009

Related U.S. Application Data

(60) Provisional application No. 61/043,843, filed on Apr. 17, 2008.

(51) Int. Cl.
*A63B 69/36* (2006.01)

(52) U.S. Cl.
USPC ..... 473/257; 473/227; 473/409

(58) Field of Classification Search
USPC ..... 473/219, 226, 227, 228, 231, 232, 239, 473/257, 258, 266, 409
See application file for complete search history.

(56) References Cited

U.S. PATENT DOCUMENTS

| | | | | | |
|---|---|---|---|---|---|
| 3,109,244 | A | * | 11/1963 | Trifaro et al. | 434/252 |
| 3,170,690 | A | | 2/1965 | Goranson | |
| 3,588,102 | A | * | 6/1971 | Gifford | 482/106 |
| 3,663,019 | A | * | 5/1972 | Palotsee | 473/295 |
| 3,829,092 | A | * | 8/1974 | Arkin | 473/288 |
| 4,889,343 | A | | 12/1989 | Nielsen | |
| 4,913,441 | A | | 4/1990 | Freer | |
| 5,106,095 | A | * | 4/1992 | Pitkethly | 473/201 |
| 5,167,415 | A | | 12/1992 | Iandola | |
| 5,167,596 | A | * | 12/1992 | Ferber | 482/46 |
| 5,255,994 | A | | 10/1993 | Stein | |
| 5,454,568 | A | | 10/1995 | Richardson | |
| 5,520,392 | A | | 5/1996 | Foresi et al. | |
| 5,547,196 | A | | 8/1996 | Izett et al. | |
| 5,803,875 | A | * | 9/1998 | Colace | 482/83 |
| 5,954,592 | A | | 9/1999 | Laffer et al. | |
| 5,997,408 | A | | 12/1999 | Bankhead | |
| 6,217,495 | B1 | * | 4/2001 | Yalch | 482/109 |
| D460,132 | S | * | 7/2002 | Asuncion et al. | D21/684 |
| 7,244,187 | B2 | | 7/2007 | Brooks | |

FOREIGN PATENT DOCUMENTS

| | | |
|---|---|---|
| CA | 2167906 A1 | 1/1996 |

* cited by examiner

*Primary Examiner* — Nini Legesse
(74) *Attorney, Agent, or Firm* — Roger A. Jackson

(57) ABSTRACT

A golf-swing training device is provided which has a straight shaft with first and second ends and a central handle. The device further includes first and second heads secured to the first and second ends of the shaft, respectively. The first head has a front surface facing a first direction and an outer edge pointing in a direction 90° from the direction the first front surface of the first head faces. The second head has a front surface facing a second direction, opposite the first direction, and an outer edge pointing in a direction 90° from the direction the front surface of the second head of the second head faces and opposite the direction that the outer edge of the first head points.

10 Claims, 9 Drawing Sheets

200 202

GOLF-SWING TRAINING DEVICE

RELATED APPLICATIONS

The present application claims benefit of U.S. Provisional Application Ser. No. 61/043,843, GOLF-SWING TRAINING DEVICE, filed on Apr. 10, 2008, which application is incorporated herein by reference in its entirety.

TECHNICAL FIELD

The present invention relates generally to golf and, in particular, to a device used for improving a golfer's swing.

BACKGROUND ART

Golf is a sport which requires a great deal of practice for a golfer to play well. However, unless the golfer is practicing correctly, he or she will become proficient at playing poorly or, at best, at playing merely adequately, never reaching his or her full potential. Even a professional golfer will periodically utilize coaching and/or training aids when swing flaws appear from time to time. It is known that when a muscle or group of muscles repeat the same motion, that motion is "memorized." It will be appreciated, therefore, that if the motion is incorrect or less than ideal, it will be memorized no differently that if it was the proper motion. And, once a motion is memorized, it takes a great deal of effort to replace it with a different, and preferably more ideal, motion. Therefore, it is important that a correct motion is practiced until it is memorized.

SUMMARY OF THE INVENTION

The present invention provides a golf-swing training device which has a straight shaft with first and second ends and a central handle. The device further includes first and second heads secured to the first and second ends of the shaft, respectively. The first head has a front surface facing a first direction and an outer edge pointing in a direction 90° from the direction the front surface of the first head faces. The second head has a front surface facing a second direction, opposite the first direction, and an outer edge pointing in a direction 90° from the direction the front surface of the second head faces and opposite the direction that the outer edge of the first head points.

It is intended that, by regularly practicing with the golf-swing device of the present invention, a golfer's swing memory and muscles will become trained to promote the proper swing path. Such training is then able to transfer over to the golfer's use of a regular club.

DETAILED DESCRIPTION OF THE PREFERRED EMBODIMENT

When a golfer swings a club, it is important to "keep his/her eye on the ball" in order to strike the ball correctly. However, if the golfer is watching the ball, he or she cannot also watch the club head except during the very beginning and very end of the swing. It is difficult, therefore, for the golfer to know if the club is traveling in the correct trajectory. It is also difficult for the golfer to know if the club is being twisted even slightly during the swing.

Figure 1A:
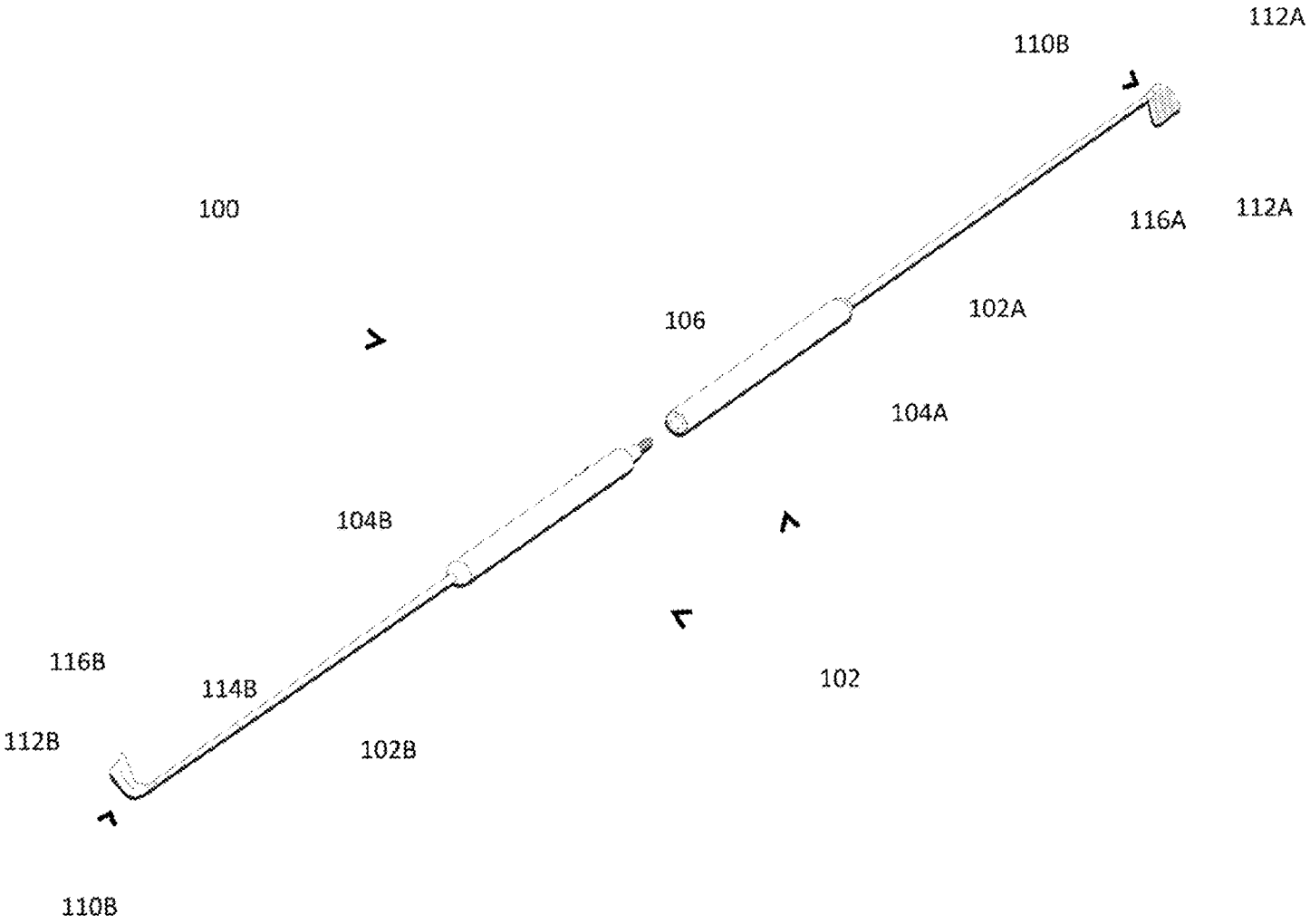
FIGS. 1A and 1B illustrate embodiments of a golf training device.
Figure 1B:
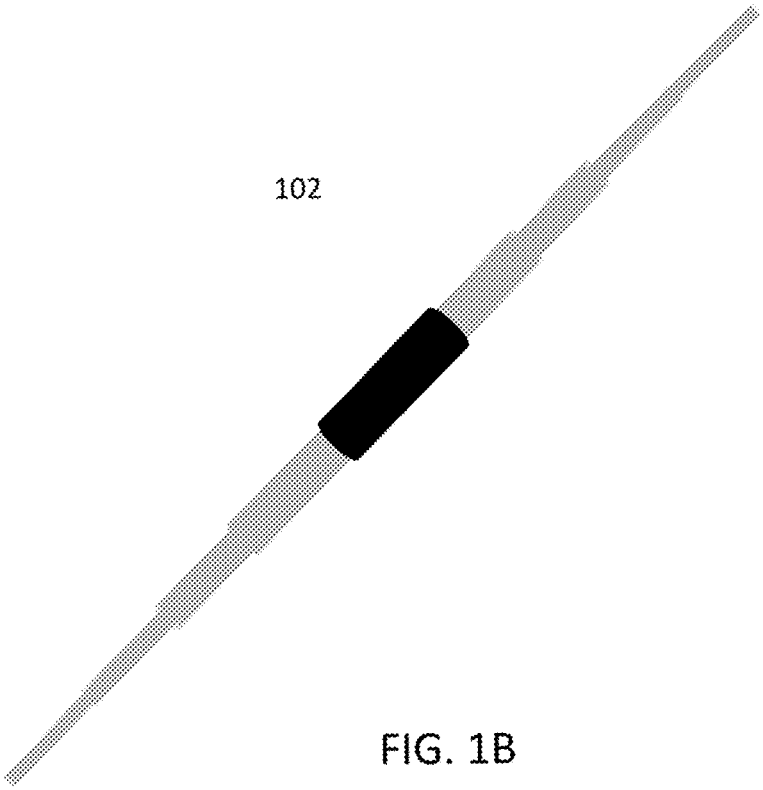

The present invention provides a golf training device which enables a golfer to watch a club head during most of the swing and detect aberrations in his or her swing. As illustrated in FIG. 1A, the device 100 resembles a double-length, double-headed golf club. The device 100 includes a straight shaft 102 having a first section 102A and a second section 102B. At least the first section 102A includes a handle 104A; for symmetry, the second section 102B may also include a handle 104B. The two sections 102A, 102B may be fabricated as a continuous shaft. Alternatively, for ease of transportation and storage the shaft 102 may be fabricated in two or more separate sections (two sections are illustrated) which fit together at a joint 106 or as two or more telescoping sections which collapse (FIG. 1B).

A club head 110A, 110B is secured to the end of the shaft sections 102A, 102B, respectively. both heads 110A, 110B have a front surface 112A, 112B and a rear surface 114A, 114B. In FIG. 1A, only the front surface 112A of the first head 110A and the rear surface 114B of the second head 110B are visible. Furthermore, each head 110A, 110B has an outer edge 116A, 116B relative to the shaft 102. When the device 100 is assembled, either by the manufacturer if the shaft 102 is a single section or by the golfer if the shaft 102 comprises multiple sections 102A, 102B, the two heads 110A, 110B are positioned to be the mirror images of each other. That is, as shown in FIG. 1A, the front surfaces 114A, 114B of the heads 110A, 110B will face directions each other (180° apart). The outer edges 116A, 116B will also point in directions opposite each other (180° apart) and 90° from the direction in which the corresponding front surfaces 114A, 114B, respectively, are facing. To ensure proper alignment of the heads relative to each other, the joint 106 between the two shaft sections 102A, 102B may be keyed, such as with one or more tabs on one shaft and a like number of mating slots on the other shaft. As one alternative, alignment arrows or other indicators may be printed or embossed on the shaft sections where they join. It will be appreciated that other means of alignment may be used.

Figure 2:
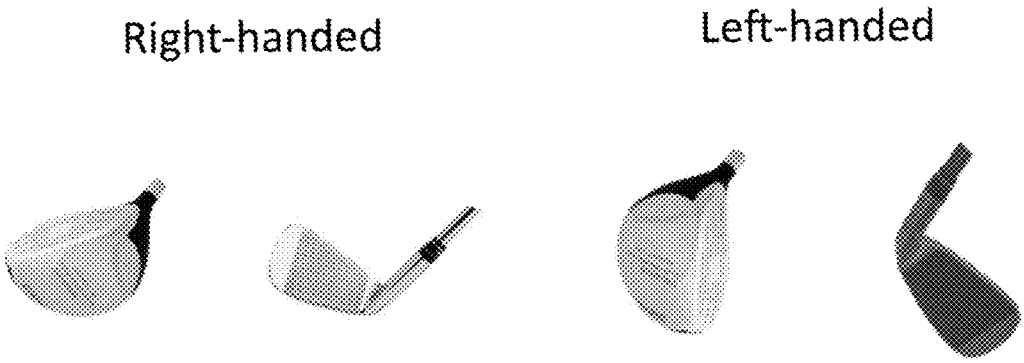
FIG. 2 illustrates removable left and right handed heads which may be used with the golf training device.

If desired, the heads 110A, 110B may be removable and replaced by different heads (FIG. 2). For example, heads for an iron may be replaced by heads for a driver. Proper alignment of the heads on the shaft 102 or shafts 102A, 102B may be assured in any of the same ways discussed above with respect to the alignment of the shaft sections 102A, 102B. Alternatively, a manufacturer may offer various models of the device 100, each with a different set of heads. It will also be appreciated that the shaft 102, or the shaft sections 102A, 102B, may be fabricated in various lengths to accommodate golfers of different heights and the device 100 may be fabricated for both right-handed and left-handed golfers or be provided with removable sets of left- and right-handed heads (FIG. 2). Furthermore, one section of the shaft 102A and head 110A may be fabricated from the same material and in the same weight as a normal club while the other section 102B and head 110B may be fabricated from much lighter materials in order that the total weight of the device more closely approximates the weight of a normal club. Alternatively, the two sections 102A, 102B and heads 110A, 110B may be fabricated from the same materials for a more symmetric "feel."

FIGS. 3A-3G illustrate the use of the device 100 by a golfer. The golfer takes a normal or conventional stance holding one of the handles 104A of one of the sections 102A with a conventional grip. The head 110A is centered and slightly in front of the golfer with the front face 112A facing the ball. When the golfer is in the proper stance, the other shaft section 102B will lie against the golfer's left side (if he or she is right handed) near his or her waist and extend upwards and away from the golfer, as illustrated.

Figure 3A:
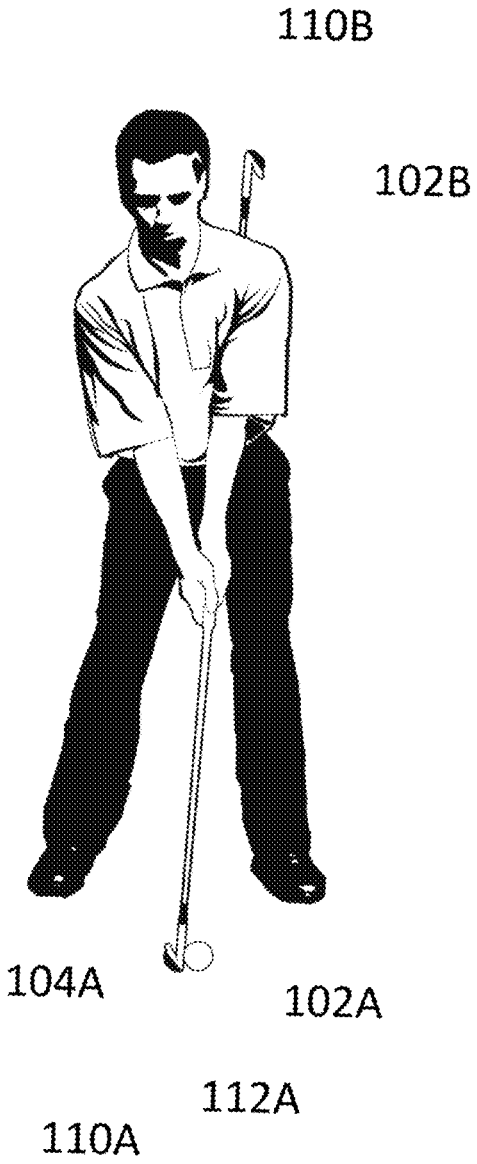
FIGS. 3A-3G are sequential illustrations of the golf training device as used by a golfer.
Figure 3B:
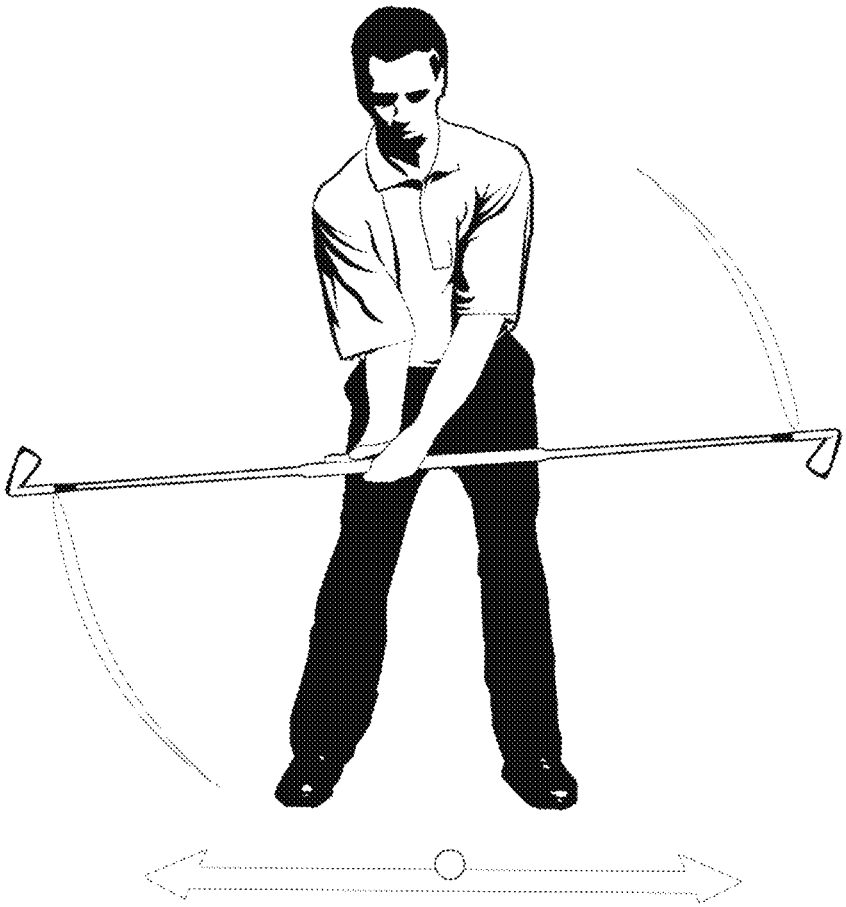
Figure 3C:
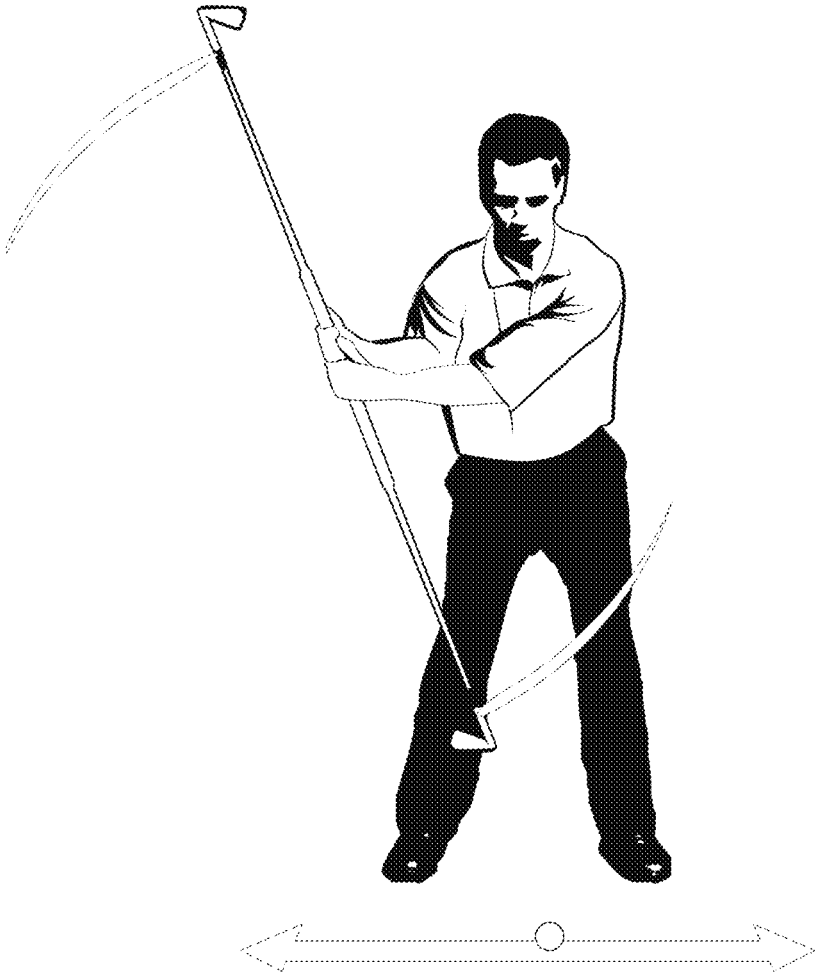
Figure 3D:
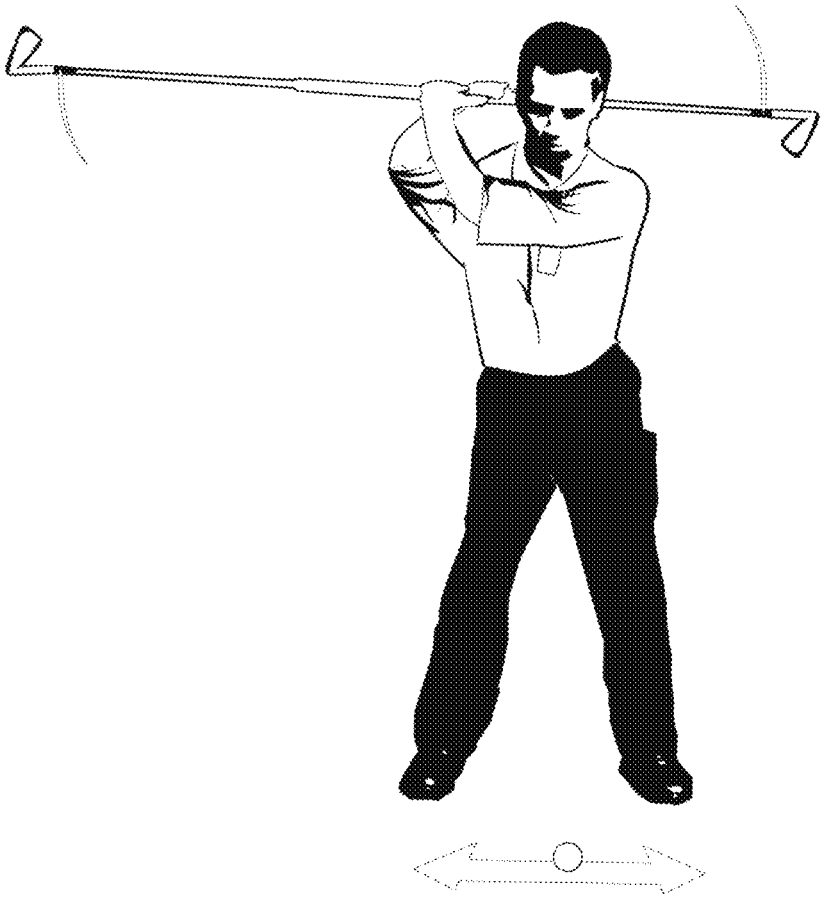
Figure 3E:
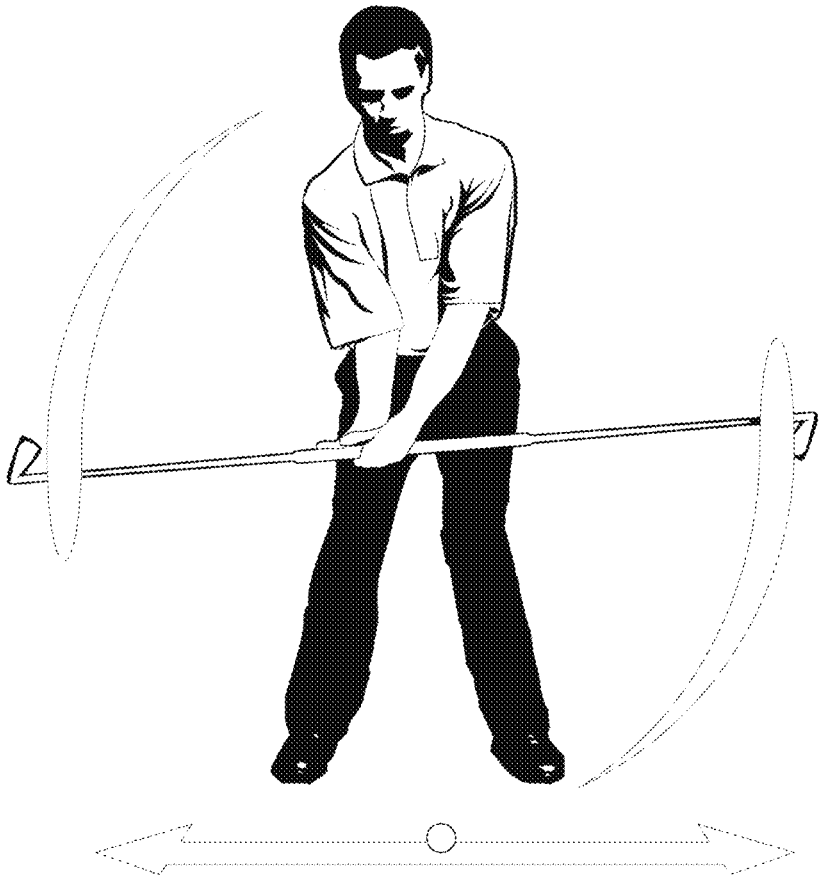
Figure 3F:
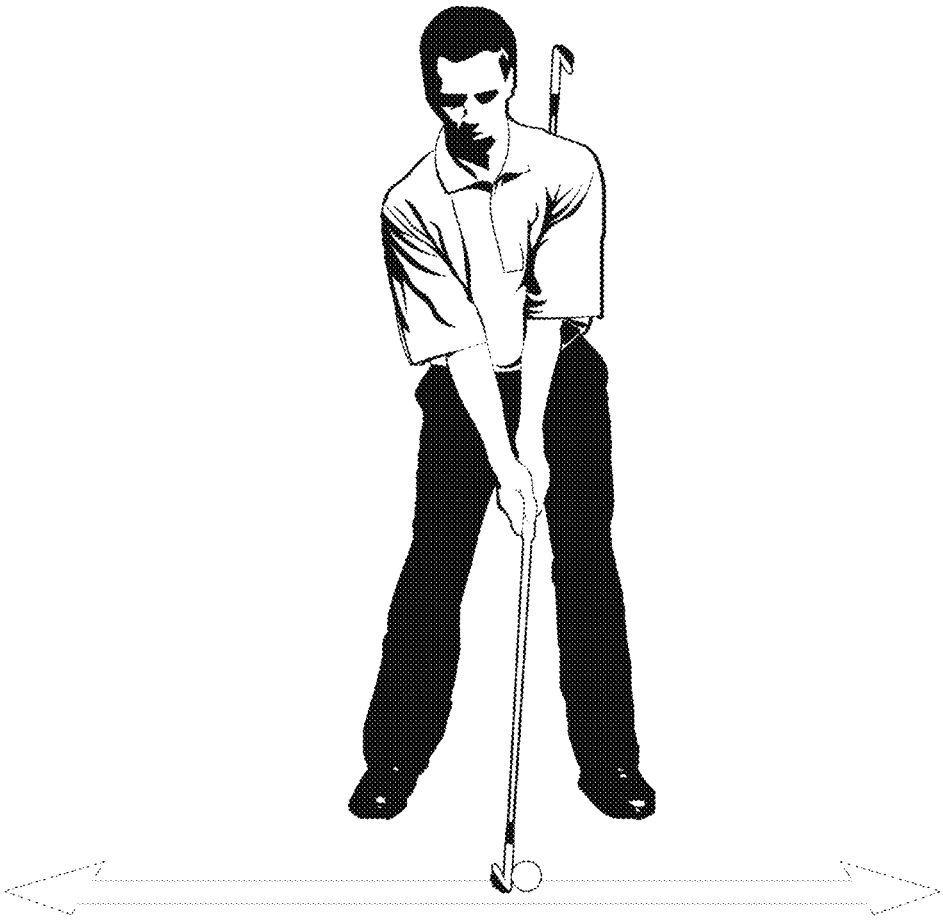
Figure 3G:
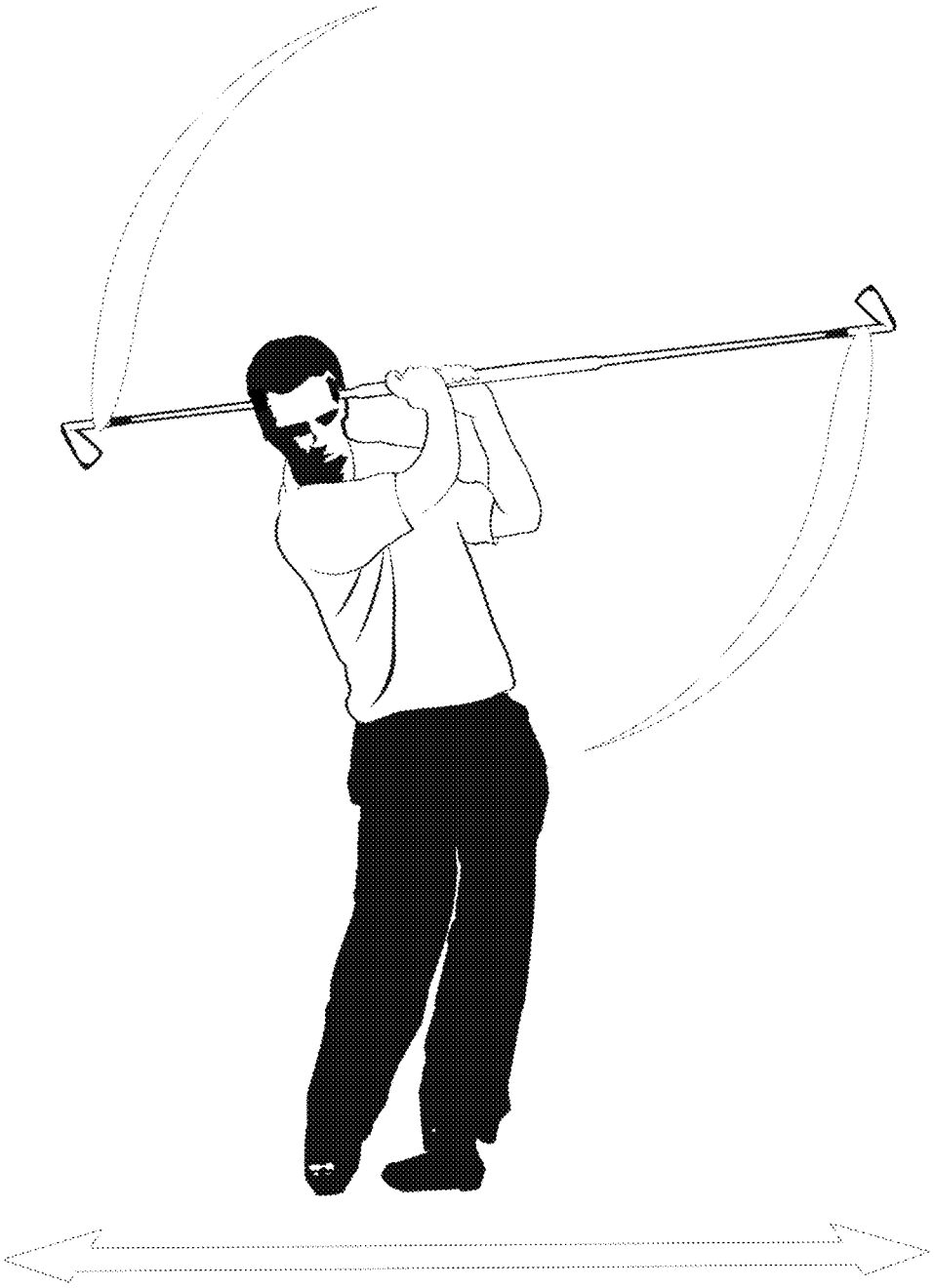

As the golfer swings through the backstroke, FIGS. 3B-3D, the first shaft section 102A and head 110A follow a particular swing path around the side and behind the golfer. The second shaft section 102B and head 110B will follow a corresponding path but in front of the golfer where he or she can see the second shaft 102B and head 110B. When the golfer swings through his or her downstroke, FIGS. 3E-3G, the first shaft section 102A and head 110A and the second section 102B and head 110B follow paths which are opposite their paths during the backstroke. (In actual use, it may be preferable for the golfer to not complete the follow-through portion of his or her swing (FIG. 3G).) Again, the golfer is able to see the second section 102B and head 110B during most of this part of the swing, providing a mirror image of where the first section 102A and head 110A are and what they are doing throughout the back swing.

Because the golfer is able to see the second shaft section 102B and head 110B during much of his or her stroke, he or she is able to determine if the first shaft section 102A and head 110A is following the proper path. In addition, by watching the angle of the second head 110B, the golfer can determine if his or her hands are twisting, thereby causing the first head 110A to deviate from the proper angle when it strikes the ball, resulting in a hook or a slice.

A mat 200 may optionally be placed on the ground in front of the golfer, the mat having an ideal path 202 (FIG. 3B) printed on its surface for the golfer to follow as he or she progresses through each swing.

During informal testing of the device, it has been found that by regularly practicing with the golf-swing device 100 of the present invention, a golfer will produce a consistent swing path critical for proper and solid ball contact. Such training is then able to transfer over to the golfer's use of a regular club.

The described features, structures, or characteristics of the invention may be combined in any suitable manner in one or more embodiments. In the forgoing description, numerous specific details are provided. One skilled in the relevant art will recognize, however, that the invention can be practiced without one or more of the specific details, or with other methods, components, materials and so forth. In other instances, well-known structures, materials or operations are not shown or described in detail to avoid obscuring aspects of the invention.

Additionally, the description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A golf-swing training device, comprising:

a straight shaft having first and second ends and a central handle;

a first golf head secured to the first end of the shaft, the first golf head having a first front surface facing a first direction and having a first outer edge pointing in a direction 90° from the direction that the first front surface faces; and a second golf head secured to the second end of the shaft, the second golf head having a second front surface facing a second direction, opposite the first direction, and having a second outer edge pointing in a direction 90° from the direction the second front surface faces and opposite the direction the first outer edge points.

2. The device of claim 1, wherein the shaft comprises separate first and second sections connectable to each other.

3. The device of claim 2, further comprising a keyed joint to connect the first and second sections of the shaft with the first and second front surfaces face in opposite directions.

4. The device of claim 1, wherein the shaft is twice the length of a golf club shaft used by a golfer when playing a golf game.

5. The device of claim 1, wherein the first and second golf heads are removable from the shaft.

6. The device of claim 5, wherein the first and second golf heads are heads usable by a right-handed golfer, the device further comprising:

a third golf head securable to the first end of the shaft, the third golf head being a golf head usable by a left-handed golfer; and a fourth golf head securable to the second end of the shaft, the fourth golf head being a golf head usable by a left-handed golfer.

7. The device of claim 1, wherein the first and second golf heads are driver heads.

8. The device of claim 1, wherein the first and second golf heads are iron heads.

9. The device of claim 1, wherein the shaft comprises a plurality of telescoping sections.

10. A method of training a golf swing in a golfer, comprising:

holding the central handle of a golf training device with a grip, the device having:

a straight shaft having first and second ends and a central handle;

a first golf head secured to the first end of the shaft, the first golf head having a first front surface facing a first direction and having a first outer edge pointing in a direction 90° from the direction that the first front surface faces; and a second golf head secured to the second end of the shaft, the second golf head having a second front surface facing a second direction, opposite the first direction, and having a second outer edge pointing in a direction 90° from the direction the second front surface faces and opposite the direction the first outer edge points;

assuming a stance with the first head on the ground in front of the golfer and the shaft against the golfer's left side if the golfer is right handed and against the golfer's right side if the golfer is left handed, the shaft extending upwards away and behind the golfer;

performing a backstroke with the first golf head following a swing path to the side and behind the golfer and the second golf head following a corresponding swing path in front of the golfer; and performing a downstroke during which the first and second golf heads follow swing paths that are opposite the respective swing paths the first and second golf heads took during the backstroke.

* * * * *